United States Patent [19]

Aurand et al.

[11] Patent Number: 4,940,864

[45] Date of Patent: Jul. 10, 1990

[54] FLOATING OPERATING AND RELEASE PAINT SWITCH ACTUATOR

[75] Inventors: Kenneth Aurand, Geneva; James F. L. Blair, St. Charles, both of Ill.

[73] Assignee: Saint Switch, Inc., St. Charles, Ill.

[21] Appl. No.: 243,506

[22] Filed: Sep. 12, 1988

[51] Int. Cl.[5] ..... H01H 13/14

[52] U.S. Cl. ..... 200/342

[58] Field of Search ..... 200/342, 345, 341

[56] References Cited

U.S. PATENT DOCUMENTS 3,412,223 11/1968 Schad ..... 200/342 X 3,624,330 11/1971 Bognar et al. ..... 200/324 X 4,064,381 12/1977 Mullen et al. ..... 200/342 X

*Primary Examiner*—Renee S. Luebke

*Attorney, Agent, or Firm*—Wood, Phillips, Mason, Recktenwald & Vansanten

[57] ABSTRACT

A switch actuator includes a base and a plunger mounted for movement on the base. An electrical contact is mounted for relative movement on the base to establish an electrical connection. An actuator assembly is mounted for movement on the base and is operatively associated with the plunger for effecting movement of the electrical contact to alter the state of the electrical connection. The actuator includes a pair of relatively movable members with a wedge member therebetween. The wedge member is effective to cause conjoint movement of the movable members and to allow relative overtravel movement between the members. The relationship between the electrical contact and the actuator assembly is adjustable to vary the movement differential of the switch actuator.

12 Claims, 3 Drawing Sheets

FLOATING OPERATING AND RELEASE PAINT SWITCH ACTUATOR

FIELD OF THE INVENTION

This invention generally relates to the art of electrical switches and, particularly, to electrical switches which incorporate overtravel either in the switch itself or in an actuating mechanism attached to or operatively associated with the switch or switch contacts.

BACKGROUND OF THE INVENTION

Many electrical switches are of the type which encounter "overtravel" after the state of the electrical connection of the switch has been altered. In most instances, an actuator is employed to operate the switch. The actuator and its associated components usually go through a "pretravel" before electrical connection is made or the switch state is altered, which sometimes is termed the "operating point". The actuator and/or its associated components then go through an overtravel condition of movement after the operating point. Upon release of the actuator, reverse movement usually takes place and a "release point" occurs when the electrical connection and its associated circuit is transferred back to its original state. This usually occurs sometime during return movement of the actuator.

In some instances, such as shown in U.S. Pat. No. 4,778,960 to James Blair, dated Oct. 18, 1988 a floating operating and release point switch is disclosed. This concept allows the switch to utilize a movement differential to actuate or deactuate a circuit rather than cause actuation or deactuation at respective absolute positions.

Regardless of the precise type of switch of the character described above, a constant problem in manufacturing such switches is maintaining close tolerances required in many applications and compensating for wear during use which, in essence, simply magnifies the tolerance problem. This invention is directed to a new and improved switch actuator which includes features directed to solving these problems.

SUMMARY OF THE INVENTION

An object, therefore, of the invention is to provide a new and improved switch actuator of the character described which includes an "overtravel" condition in the switch and which involves movement differential in the switch actuator.

In the exemplary embodiment of the invention, a switch actuator is disclosed to include a base or housing and a plunger mounted for movement in the base and having an exposed operating end. Electrical contact means are relatively movably mounted on the base for establishing an electrical connection. Actuator means are mounted for movement on the base and operatively associated with the plunger for effecting movement of the electrical contact means to alter the state of the electrical connection.

One novel feature of the invention is the actuator means which include at least a pair of relatively movable members with wedge means operatively associated therebetween. The wedge means is effective to cause conjoint movement of the movable members and to allow relative overtravel movement between the members. In the preferred embodiment, the wedge means include a wedge member having a wedge surface oblique to the direction of movement of the actuator means for engaging a complementary oblique wedge surface on one of the actuator members. With such a construction, manufacturing tolerance problems are greatly reduced, and any wear in the actuator during use simply is accommodated by the inherent nature of the wedge means.

More specifically, in the preferred embodiment, the electrical contact means has an elongated rod connected to electrical contacts. A first actuator member comprises an inner sleeve surrounding the rod, and a second, lost motion actuator member comprises a second, outer sleeve surrounding the first sleeve. A wedge member is sandwiched between portions of the first and second sleeves. The plunger engages the wedge member to effect conjoint movement of the sleeves, but relative movement between the sleeves are afforded to allow for overtravel in the switch.

Another feature of the invention involves the provision of means for adjusting the overtravel distance of the actuator, namely by adjusting the distance between the operating point and the release point of the switch. This often is termed the "movement differential", and the invention contemplates means for adjusting this differential.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 1:
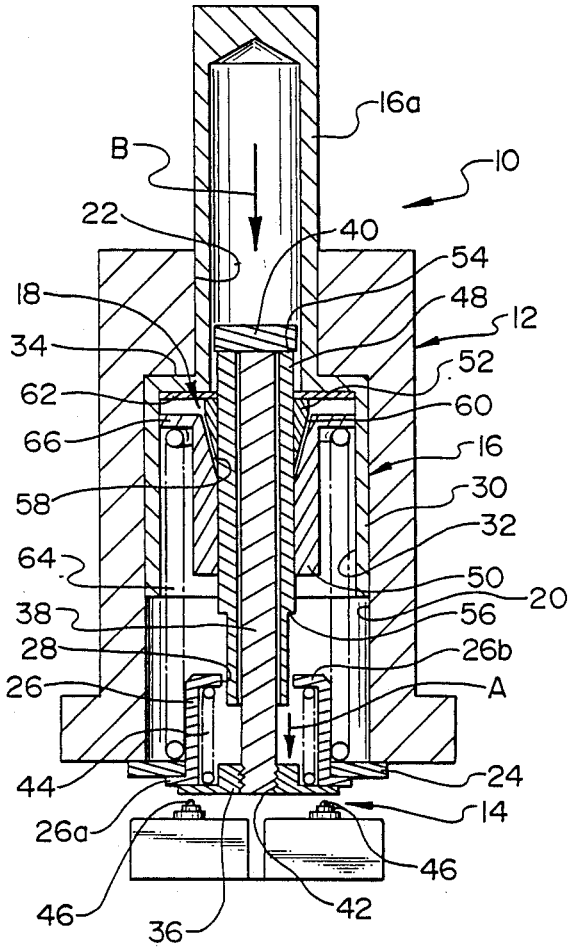
FIG. 1 is a substantially axial section through a switch actuator embodying the concepts of the invention, with all components in an unoperated state.
Figure 2:
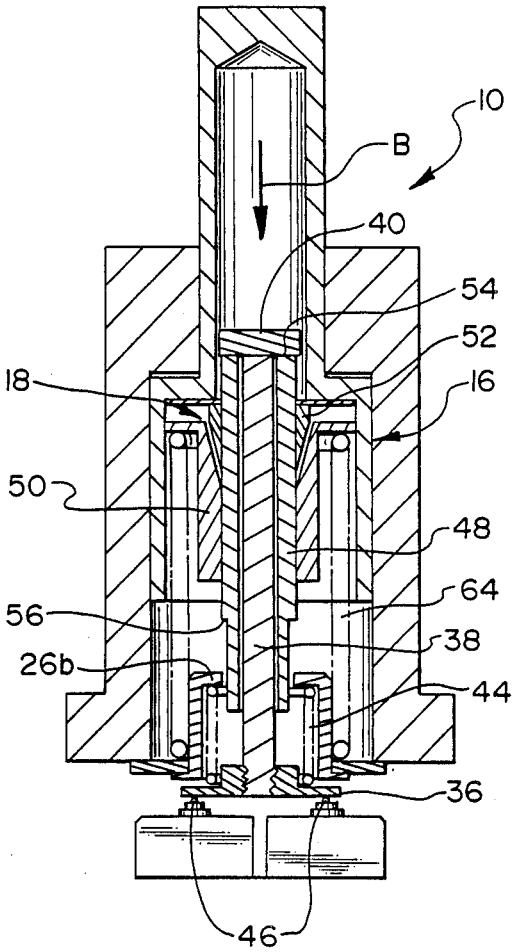
FIG. 2 is a section similar to that of FIG. 1 with the plunger and actuator means and their associated components moved downwardly to the operating point of the switch contact means.

Referring to the drawings in greater detail, and first to FIG. 1, a switch actuator, generally designated 10, is disclosed for providing the functions and features described above. Generally, switch actuator 10 includes a base or housing, generally designated 12; a basic switch actuating device which includes electrical contact means, generally designated 14, mounted for movement relative to the housing for establishing an electrical connection; a plunger, generally designated 16, mounted for movement in the housing and having an exposed operating end 16a outside the housing; and frictional actuator means, generally designated 18, mounted for movement in the housing and operatively associated with the plunger for effecting movement of the electrical contact means to alter the state of the electrical connection.

More particularly, base or housing 12 includes an interior cavity 20 within which most of the operative components of the switch actuator are housed. Operating end 16a of plunger 16 projects through a hole 22 in the top of housing 12 in communication with interior cavity 20. An end cap 24 closes the bottom of cavity 20 and an interior abutment member 26 projects upwardly into the cavity. For purposes described herein and in the claims hereof, end cap 24 and abutment member 26, in essence, are part of the base or housing of the switch actuator in that they are rigidly fixed to housing 12, as by appropriate adhesive or the like. End cap 24 is fixed directly to the bottom of the housing, and a lower outwardly projecting flange 26a of abutment member 26, in turn, is fixed rigidly to end cap 24. Abutment member 26 includes a radially inwardly projecting abutment flange 26b defining a central aperture 28. For purposes described hereinafter, abutment flange 26b forms the abutment means to define the limit of travel of frictional actuator means 18.

Plunger 16 has an enlarged diameter portion 30 defining an interior cavity portion 32 which receives actuator means 18 interiorly of the lower plunger portion within cavity 20 of housing 12. The upper or outer limit position of the plunger is defined by abutting shoulders between the top of enlarged plunger portion 30 and housing 12, as at 34.

A contact member 36 is mounted onto a lower distal end of an elongated rod 38 which projects all the way upwardly through housing cavity 20 and plunger cavity 32, into the interior of plunger end 16a, and terminates in an abutment head 40 at the upper distal end of the rod. For purposes described hereinafter, contact member 36 is threaded to the lower distal end of rod 38, as at 42. Biasing means in the form of a coil spring 44 is maintained under compression between contact member 36 and the underside of abutment flange 26b to bias the contact members of the basic switch actuating device downwardly in the direction of arrow "A". Of course, in the condition shown in FIG. 1, the contact member cannot move downwardly because of the abutment of head 40 with actuator means 18, as described hereinafter. However, upon downward movement of the contact member 36, rod 38 and head 40, the contact member will engage outside contacts 46 to either make an electrical connection or, generally, to alter the state of the electrical connection. In the basic switch actuating device shown, contacts 46 actually are spring loaded and can move.

Frictional actuator means 18 generally includes a pair of relatively movable members 48 and 50 and a cooperating wedge member 52 therebetween, whereby the wedge member is effective to cause conjoint movement of the movable members.

More particularly, first, relatively movable actuator member 48 is in the form of an inner sleeve surrounding rod 38. The upper distal end of sleeve 48 is abutable with head 40, as at 54. The lower distal end of sleeve 48 projects through aperture 28 centrally of abutment flange 26b of abutment member 26. The sleeve is formed with an exterior peripheral shoulder 56 for abutting abutment flange 26b when the sleeve is moved downwardly in the direction of arrow "A". The distance that shoulder 56 can travel "sets" the differential.

Second actuator member 50 is in the form of a second sleeve surrounding first actuator sleeve 48. In essence, second actuator sleeve 50 defines a "lost motion" member of the actuator means. In other words, sleeve 50 holds wedge member 52 for continuing movement of sleeve 48. Sleeve 50 is formed with a wedge surface 58 for engaging a complementary wedge surface 60 of wedge member 52. As shown, wedge surfaces 58 and 60 are oblique to the direction of movement of the actuator means, i.e., the direction of movement of the entire switch actuator. Wedge member 52 is engageable by plunger 16 to move the wedge member downwardly in wedging engagement between actuator sleeves 48 and 50 which "locks" the sleeves together for conjoint movement under the forces of friction between the opposed engaging surfaces of the wedge member and the sleeves. Actually, wedge member 52 is engaged by a washer-like member 62 which, in turn, is engaged by the plunger. The washer is used for manufacturing purposes so as to engage the full width of the top of the wedge member.

Lastly, a larger coil spring 64 is maintained under compression between housing end cap 24 and a radially outwardly projecting flange 66 of outer actuator sleeve 50 to bias the actuator means 18 upwardly, opposite the direction of arrow "A" for purposes described hereinafter. Spring 64 also provides the force applied to wedge member 52 which forms the frictional engagement of the actuator means, and thereby adjusts for wear of the wedge member. As the wedge member wears, the gap between washer 62 and flange 66 decreases.

The operation of switch actuator 10 now will be described, and reference is made to FIGS. 2–5 in addition to FIG. 1. Reference numerals have been applied to identical components in all Figures, where applicable. In operation, switch actuator 10 is actuated by depressing plunger 16, i.e. pushing down on exposed operating end 16a in the direction of arrow "B". The plunger, through washer 62, will engage wedge member 52 to move the wedge member downwardly and lock inner and outer actuator sleeves 48 and 50, respectively, for conjoint movement downwardly with the plunger. As the plunger and the components of the actuator means move downwardly, member 36 will follow the downward movement. This is effected by the biasing of coil spring 44, as head 40 at the top of rod 38 engages and follows the top of inner sleeve 48, as at 54. Once engagement is made by contact member 36 with contacts 46 (see FIG. 2), further downward movement of the electrical contact means (i.e., contact member 36, elongated rod 38 and head 40) is stopped.

Figure 3:
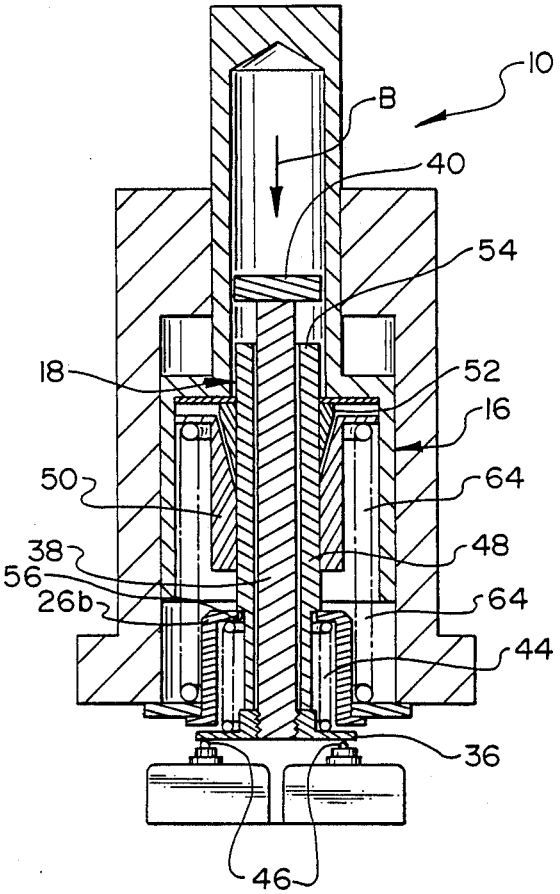
FIG. 3 is a view similar to that of FIGS. 1 and 2, with the plunger and actuator means moved further downward through a first stage of overtravel movement.

Further movement of plunger 16 and actuator means 18 downwardly in the direction of arrow "B" effects overtravel movement of the switch actuator until shoulder 56 of inner actuator sleeve 48 abuts against abutment flange 26b, as shown in FIG. 3. This stops any further movement of the inner sleeve.

Figure 4:
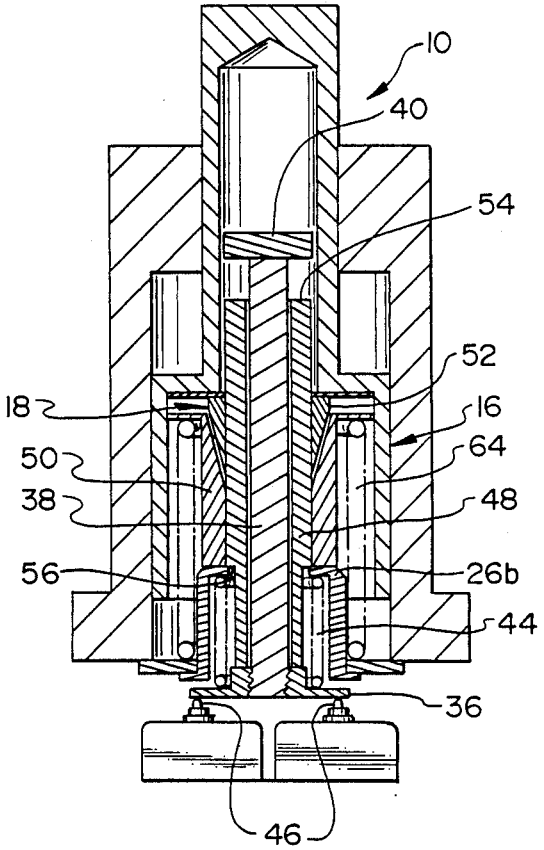
FIG. 4 is a view similar to that of FIGS. 1–3, with the plunger and a portion of the actuator means moved still further downward during a second stage of overtravel movement.

However, further overtravel of plunger 16 can be effected as wedge member 52 and outer actuator sleeve 50 continue downward movement until the lower end of the outer sleeve abuts against abutment flange 26b, as shown in FIG. 4. This further overtravel movement is allowed simply by frictional sliding engagement between wedge member 52 and the outer sleeve along the outside surface of inner sleeve 48. Of course, all of this downward movement is opposed by the forces of coil spring 64.

Figure 5:
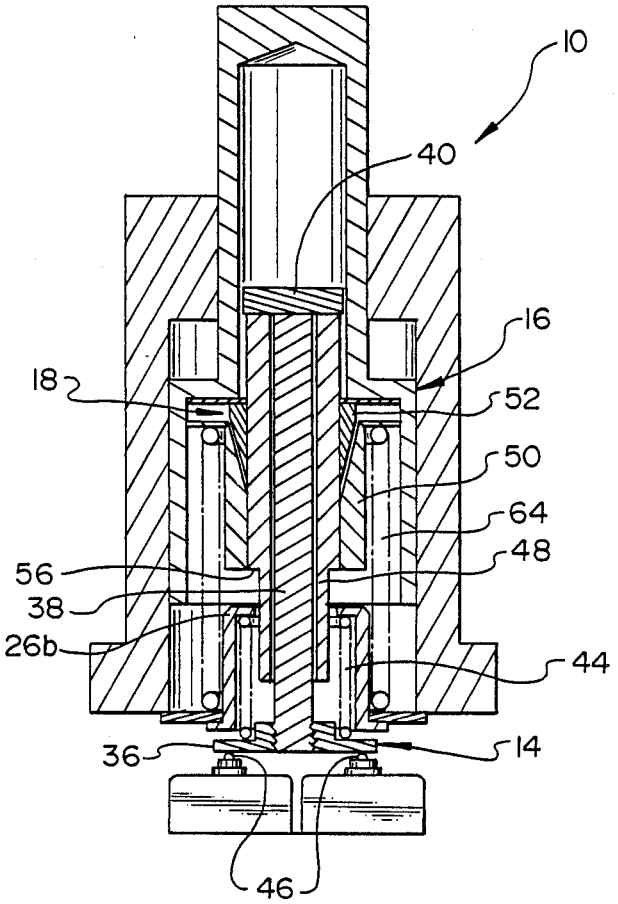
FIG. 5 is a view similar to that of FIGS. 1–4, with the plunger and actuator means moved back upwardly to the release point of the switch.

Upon release of plunger 16, the biasing of coil spring 64 upwardly against outer actuator sleeve 50 again locks the outer sleeve to inner actuator sleeve 48 by the wedging action of wedge member 52. Actuator means 18 (i.e. outer sleeve 50, wedge member 52 and inner sleeve 48) are moved upwardly by coil spring 64 until the upper end of inner actuator sleeve 48 engages head 40 of the electrical contact means. This condition, although momentary, is shown in FIG. 5. Generally, this is the release point of the switch actuator. However, with the basic switch actuating device shown, sleeve 48 may travel upwardly until it compresses spring 44 sufficiently to move member 14 upwardly to cause spring loaded contacts 46 to move and change the contacts of the basic switch actuating device.

After reaching the release point, coil spring 64 further moves the entire assembly, including actuator means 18, plunger 16 and electrical contact means 14 back to their original condition as shown in FIG. 1. Of course, as can be seen by the size of springs 44 and 64, the upper biasing forces of spring 64 overcome the downward biasing forces of spring 44 to return the electrical contact means back to its original state (i.e. FIG. 1).

As stated above, a feature of the invention is the provision of means for adjusting the differential movement of the switch actuator (i.e. the distance between the operating point and the release point of the switch). This is accomplished by the threaded engagement 42 between the lower distal end of elongated rod 38 and contact member 36. It can be understood that by rotating rod 38, the axial position of head 40, which is fixed to the rod, will move. In turn, this moves the axial position of inner actuator sleeve 48. By adjusting the axial position of inner actuator sleeve 48, the original distance between shoulder 56 on the inner sleeve and abutment flange **26*b* is varied or adjusted. Therefore, on the return "stroke" of the switch actuator, the distance that the inner sleeve moves upwardly to engage head 40 to release the switch by separating contacts 36 and 46** will be adjusted which effectively adjusts the movement differential of the entire switch actuator.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

We claim:

1. A switch actuator, comprising:

a base;

a plunger mounted for movement on the base;

electrical contact means mounted for movement relative to the base for establishing an electrical connection; and actuator means mounted for movement on the base and operatively associated with the plunger for effecting movement of the electrical contact means to alter the state of the electrical connection, the actuator means including at least a pair of relatively movable members with wedge means therebetween, the wedge means being separate from the movable members and being effective to cause conjoint movement of the movable members.

2. The switch actuator of claim 1, including means for biasing said electrical contact means in a given direction of the actuator means, the electrical contact means being operatively associated with the actuator means as to follow movement of the actuator means in said given direction to a point of establishing said electrical connection.

3. The switch actuator of claim 1, including abutment means on the base for engaging one of said movable members in its path of movement while allowing the other member and the plunger to overtravel the one movable member.

4. A switch actuator, comprising:

a base;

a plunger mounted for movement on the base in a given direction from an unoperated position;

electrical contact means mounted for movement relative to the base for establishing an electrical connection; and actuator means mounted for movement on the base and operatively associated between the plunger and the electrical contact means for effecting movement of the contact means in said given direction to alter the state of the electrical connection, the actuator means including a first member for moving the electrical contact means when the plunger is moved in said given direction, a second, lost motion member for moving the first member opposite said given direction in response to movement of the plunger opposite said given direction, and wedge means operatively associated between said first and second members, the wedge means being separate from the first and second members and being movable with the plunger in said given direction for effecting conjoint movement of the first and second members, the second member and the plunger being capable of overtravelling the first member and the contact means.

5. The switch actuator of claim 4, including biasing means for biasing said electrical contact means in said given direction, and abutment means between the electrical contact means and the first member whereby the contact means follows movement of the actuator means in said given direction to a point of establishing said electrical connection.

6. The switch actuator of claim 3, including abutment means on the base for engaging the second member in its path of movement in said given direction to allow the lost motion member and the plunger to overtravel the first member.

7. The switch actuator of claim 6, including second biasing means between the lost motion member and the base for biasing the lost motion member, the wedge means, the second member, the first member, the contact means and the plunger opposite said given direction back to said unoperated position.

8. The switch actuator of claim 4, including biasing means between the second, lost motion member and the base for biasing the second, lost motion member, the wedge means, the first member, the contact means and the plunger opposite said given direction back to said unoperated position.

9. The switch actuator of claim 4 wherein said electrical contact means is located at the end of an elongate rod defining said first member, said second member comprises a first sleeve surrounding the rod, said lost motion member comprises a second sleeve surrounding said first sleeve, and said wedge means comprises a wedge member sandwiched between portions of the first and second sleeves.

10. The switch actuator of claim 8 wherein at least one of said sleeves has a wedge surface oblique to said given direction engageable by a complementary oblique wedge surface on the wedge member.

11. The switch actuator of claim 4, including complimentarily engageable abutment means between said first member and the base, and means for adjusting a distance of travel of the first member in said given direction before the abutment means engages.

12. A switch actuator, comprising:

a base;

a plunger mounted for movement on the base;

electrical contact means mounted for movement relative to the base for establishing an electrical connection;

actuator means mounted for movement on the base and operatively associated with the plunger for effecting movement of the electrical contact means to alter the state of the electrical connection at an operating point, for allowing overtravel movement beyond the operating point, and for return movement through a release point of the electrical contact means; and means operatively associated between the actuator means and the electrical contact means for adjusting the position of the contact means relative to the plunger means.

* * * * *